US005593300A

United States Patent [19]

de Gouville

[11] Patent Number: 5,593,300

[45] Date of Patent: Jan. 14, 1997

[54] RADIANT BURNER BODY

[75] Inventor: Jean-Bernard L. M. de Gouville, Joue-les-Tours, France

[73] Assignee: Sourdillon, Veigne, France

[21] Appl. No.: 359,647

[22] Filed: Dec. 20, 1994

[30] Foreign Application Priority Data

Dec. 21, 1993 [FR] France ..... 93 15368

[51] Int. Cl.[6] ..... F23D 14/16

[52] U.S. Cl. ..... 431/328; 431/7; 431/326; 431/354

[58] Field of Search ..... 431/7, 326, 328, 431/329, 354; 126/92 AC

[56] References Cited

U.S. PATENT DOCUMENTS

| | | | |
|---|---|---|---|
| 3,401,000 | 9/1968 | Spaonara | 431/329 |
| 4,927,355 | 5/1990 | Haire et al. | 431/329 |

FOREIGN PATENT DOCUMENTS

| | | | |
|---|---|---|---|
| 0472120 | 2/1992 | European Pat. Off. . | |
| 0046918 | 4/1981 | Japan | 431/329 |
| 2055188 | 2/1981 | United Kingdom . | |
| 1597221 | 9/1981 | United Kingdom | 431/354 |
| WO93/12379 | 6/1993 | WIPO . | |

OTHER PUBLICATIONS

Patent Abstracts Of Japan, vol. 9, No. 290, 16, Nov. 1985, JP–A–60 129 515.

Patent Abstracts Of Japan, vol. 9, No. 226, 12 Sep. 1885, JP–A–60 082 711.

*Primary Examiner*—Carl D. Price
*Attorney, Agent, or Firm*—Larson and Taylor

[57] ABSTRACT

A metal body for the gas burner of an infrared radiant heater appliance, the body (1) being generally elongate in shape having an open front that receives a plate (25) for generating infrared radiation and itself being made up of two sheet metal parts (2, 3) that are cut out, stamped, folded, and assembled together. The parts comprise: a U-shaped back part (2) having an elongate main face (4) with a longitudinally elongate depression (5) shaped to form half of a tubular Venturi shape; and a dish-shaped front part (3) with an elongate bottom to the dish-shape that presents a longitudinally elongate depression (18) shaped to constitute half of a tubular Venturi, a portion of the bottom of the dish-shape situated beyond the outlet from the Venturi being cut out and folded towards the inside of the dish-shape so as to define an opening (23) through which the gas mixture passes into the dish-shape, said portion constituting a deflector (21) suitable for distributing the gas mixture inside the dish-shape.

10 Claims, 4 Drawing Sheets

RADIANT BURNER BODY

BACKGROUND OF THE INVENTION

1. Field of the Invention

The present invention relates to improvements provided to the metal body of a gas burner as used in an infrared radiant heater appliance, and in particular an appliance for home use.

2. Description of the Prior Art

In general, such burners include a sheet metal burner body that is generally elongate in shape having one large face that is open and covered by a perforated plate of refractory material, e.g. a ceramic which generates infrared radiation, when heated. The burner body is associated with conventional members such as a gas injector fixed at the inlet of a tubular Venturi which opens out into the body of the burner, an electrical igniter, a thermostat sensor, etc., which are fixed to the burner body via support tabs, themselves added to said body. In addition, members may optionally be provided inside the body of the burner to facilitate proper distribution of the gas mixture, e.g. members in the form of one or more deflector plates.

That kind of burner is obtained by assembling together numerous component parts, in particular by means of welds, bolts, or screws, thus requiring the parts to be manufactured individually, thereby lengthening manufacturing time, and leading to high unit manufacturing costs.

In addition, heater appliances are generally provided with a plurality of juxtaposed burners, with the number of burners being a function of the power of the appliance. The burners are then united on a common support plate which is subsequently mounted inside the heater appliance. It is therefore necessary to provide plates of various sizes corresponding to different numbers of burners that are to be united.

Since the manufacturers of heater appliances are not generally equipped to produce such plates and to mount burners on them, that work is done by the manufacturer of the burners who therefore delivers heating assemblies ready for installation in heater appliances by the appliance manufacturer.

In any event, regardless of the location where the heating assemblies are made up, it is necessary to manufacture and stock plates of various dimensions, thereby increasing production costs. Furthermore, the presence of the plate increases the weight of the heater appliance.

In general, it would appear highly desirable to simplify the manufacture of individual gas burners and of heating assemblies comprising a plurality of burners, so as significantly to reduce the unit manufacturing costs of a burner and also the manufacturing cost of a heating assembly comprising a plurality of burners, in particular by considerably reducing the number of component parts and by making unit burners that are modular and suitable for enabling any number of them to be assembled together simply, and by heater appliance manufacturers themselves, such that the cost price of heater appliances is, in the end, reduced.

SUMMARY OF THE INVENTION

To this end, the invention provides an improved metal body for a gas burner that is generally elongate in shape with an open front, which burner, according to the invention, is essentially characterized in that it is essentially constituted by two sheet metal parts that are cut out, stampped, and folded, namely:

a generally U-shaped back part having an elongate main face with a depression that projects outwards between the branches of the U-shape and that is longitudinally elongate, which depression is constituted to constitute one-half of a tubular Venturi shape, the branches of the U-shape extending backwards over a distance that is significantly greater than the maximum depth of the above-mentioned depression to constitute brackets suitable for engaging on a support; and a front part that is generally dish-shaped having an elongate bottom of substantially the same shape as the main face of the back part and presenting a longitudinally elongate depression projecting into the dish, shaped to constitute half a tubular Venturi shape, a portion of said bottom situated beyond the outlet of the Venturi being cut out and folded towards the inside of the dish so as to define an opening through which the mixture of gases flows between the outlet of the Venturi and the inside of the dish, thereby constituting a deflector suitable for distributing the gas mixture inside the dish;

said back and front parts being secured to each other, after each of them has been formed individually, by securing the main face of the back part to the bottom of the dish-shape of the front part.

Because of this arrangement, the metal body of the burner structurally incorporates at least the two fundamental components of the burner, namely the Venturi and the deflector plate (whose presence is necessary in the burner arrangement defined above since by having the Venturi totally incorporated inside the metal body, the outlet orifice of the Venturi is offset to the vicinity of one end of the metal body, and if there were no deflector, the gas mixture would be poorly distributed in the inside volume of the body), and such an assembly is made up structurally by uniting only two sheet metal parts that have been respectively cut out and stamped in appropriate manner and then united with each other, in particular by welding or by mechanical assembly means, without any other assembly and/or finishing step.

It is also possible to further increase the degree of integration of various members by providing for the body to present one or more of the following dispositions:

upstream from the inlet to the Venturi, the main face of the back part is cut out to form at least three parallel tongues, one being curved oppositely to the other two so that together they constitute a tubular guide for retaining a gas injector situated looking into the inlet of the Venturi;

the peripheral edge of the dish of the front part is formed to define a peripheral rim that supports a ceramic plate;

the rim of the dish of the front part is extended, adjacent to the Venturi inlet, by an external tab extending approximately parallel to the bottom of the dish-shape and shaped to support burner accessories;

the branches of the U-shape formed by the back part have their end portions curved in part or in full so as to extend approximately parallel to the above-specified main face to form plane brackets for resting against a support, and said plane brackets include projecting transverse tabs that are cut out and folded for the purpose of achieving rapid fixing with said support;

the branches of the U-shape formed by the back part are situated at the longitudinal ends of the main face of said back part, and the side edges of the back part present both cutout fingers that project sideways and sideways-directed slots defined by tongues that are cut out and deformed in opposite directions to each other, so as to receive said projecting fingers in order to enable a plurality of unit burners to be assembled together side by side and to be secured to one another;

the peripheral rim formed around the dish-shape of the front part has at least one continuous furrow formed by stamping its face against which the infrared radiation generating plate bears, the furrow serving to receive an adhesive for securing the ceramic plate in sealed manner;

the back part and the front part are secured to each other by spot welding;

the main face of the back part and the bottom of the dish-shape of the front part which co-operate with their faces pressed closely one against the other are provided with two respective complementary grooves received one in the other and extending in continuous manner around the Venturi and the outlet opening from the Venturi, said mutually-engaged complementary grooves forming a sealing gasket for the gas mixture; and the deflector cut out in the bottom of the dish-shape of the front part and then folded forwards is pierced by a multiplicity of through holes.

A preferred embodiment of a burner body in accordance with the invention combines all of the above dispositions. This provides the remarkable advantage of being able to build up a metal burner body that incorporates numerous fundamental and/or auxiliary components necessary for the operation of the burner, for forming an assembly of several burners, and for mounting in a heater appliance, while having only two different metal parts to manufacture. All of the components that form integral parts of the burner body are essentially in the form of projections, tabs, or like members which are made as a result of simple mechanical operations of cutting, folding, and optionally stamping; thus, in combination with making up the base of the burner body which incorporates the Venturi and the deflector plate, the two metal parts which alone constitute the complete burner body made in accordance with the invention may indeed have respective shapes that are complex, but they can be manufactured by a sequence of cutting, stamping, and folding steps that present-day machines are capable of performing entirely automatically, and therefore at low cost and with high production rates; the only subsequent action required for making a burner consists in installing the gas injector and the ceramic plate, and then optionally installing an electrical igniter, a thermostat sensor, an atmosphere-monitoring pilot, etc.

Similarly, the presence of fingers or of other projecting portions integrally formed with the two metal parts makes it possible to assemble burner bodies directly to one another side by side by folding and/or twisting such fingers or projections once engaged in corresponding openings, and also makes it possible to fix an assembly of several burners directly in a heater appliance, without it being necessary any longer to make use of support plates and pre-assembled burner units adapted to the power of a particular heater appliance. The above simple operations are suitable for being performed directly by heater appliance manufactures themselves on the basis of a stock of unit burners that are all identical.

The invention will be better understood on reading the following detailed description of a preferred embodiment, given purely by way of non-limiting example. In the description, reference is made to the accompanying drawings, in which:

DESCRIPTION OF THE PREFERRED EMBODIMENTS

Figure 1:
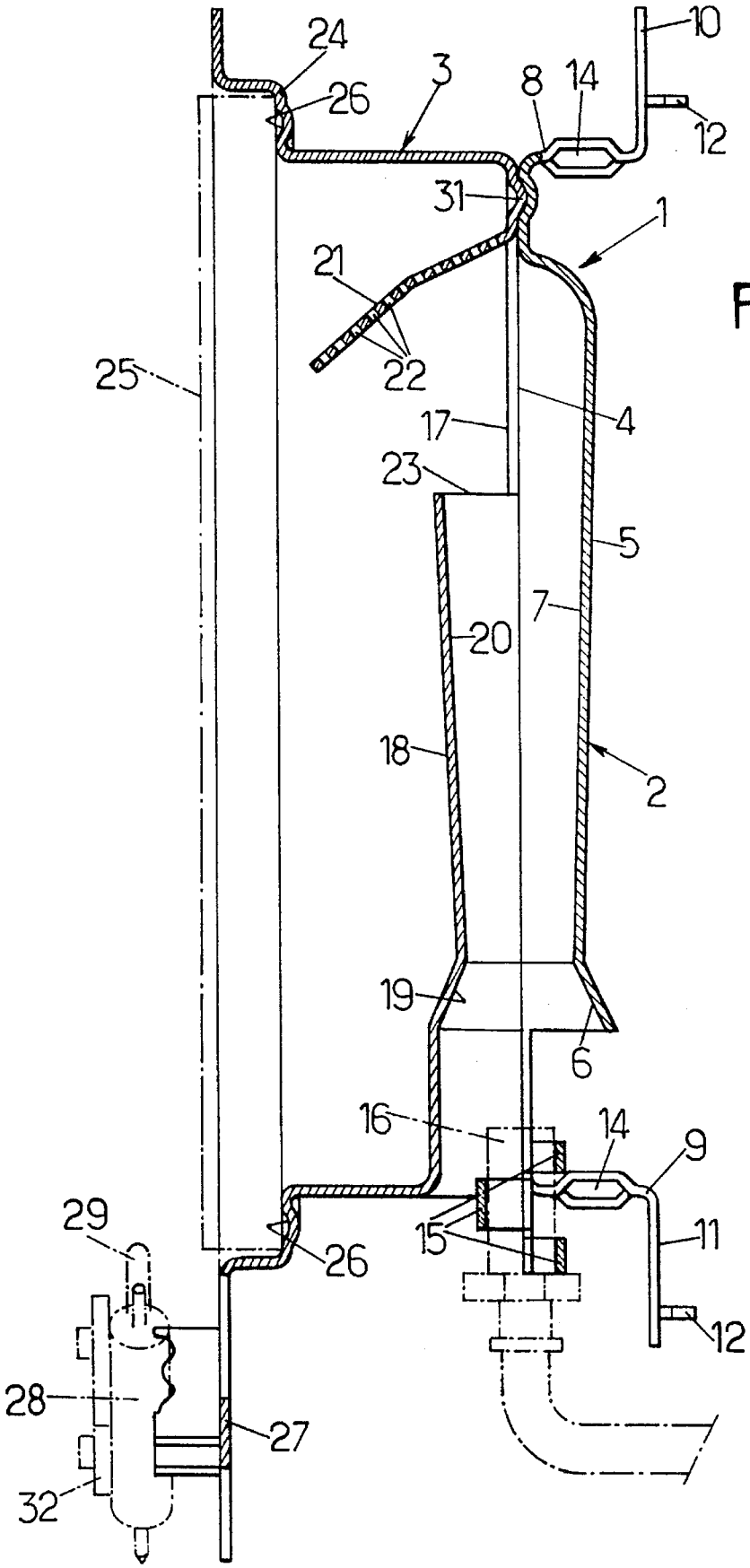
FIG. 1 is an overall view in longitudinal section of a burner body made in accordance with the invention.
Figure 2:
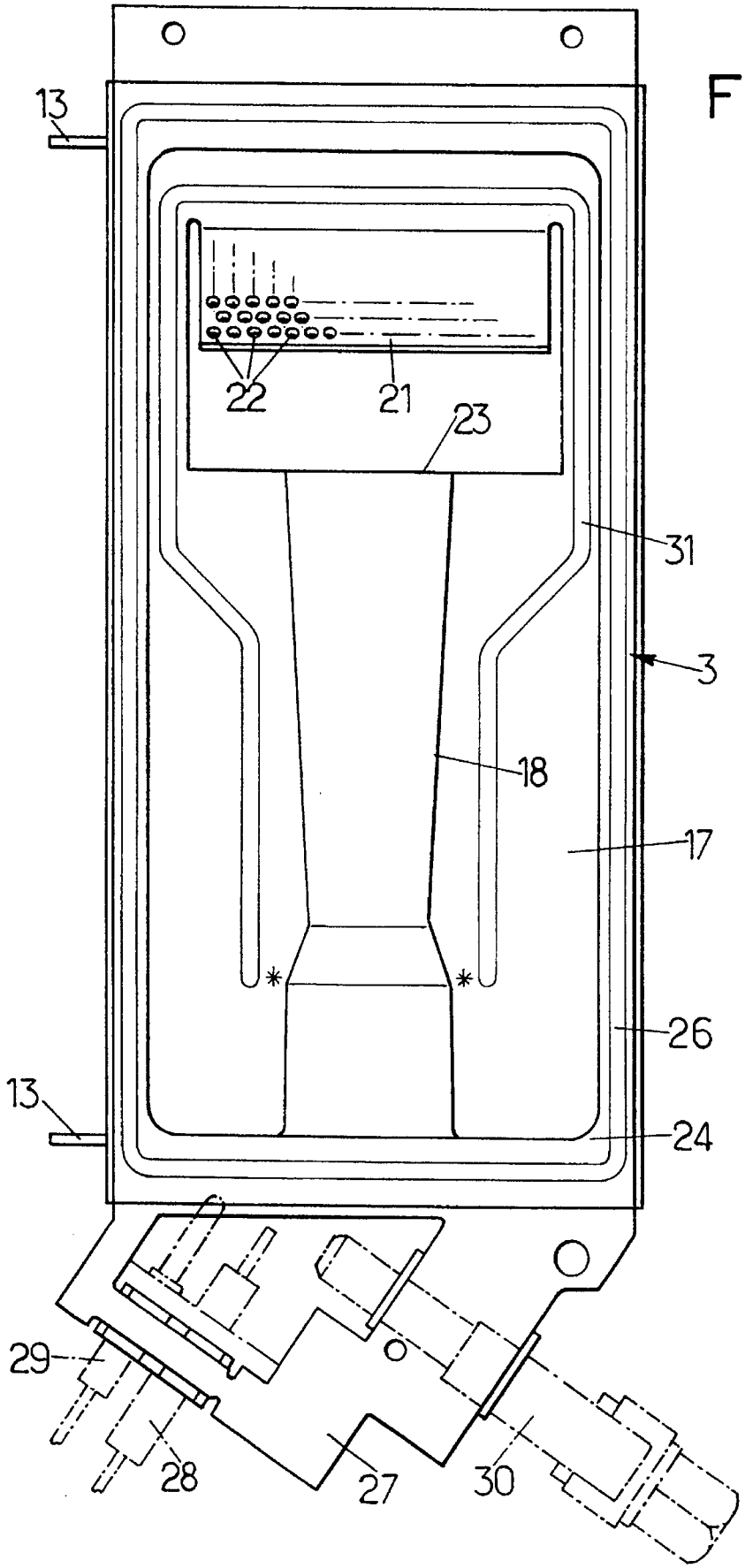
FIGS. 2 and 3 are respectively a view from in front and a view from behind the FIG. 1 burner body respectively showing its two metal component parts.

In FIGS. 1 and 2, chain-dotted lines are used to show various auxiliary members that do not form an integral part of the burner body and that are added thereto after manufacture thereof, said auxiliary members being shown to make it easier to understand the functions of various portions of the burner body.

As can be seen in FIG. 1, the burner body, which is given overall reference numeral 1, is made up of two parts only which parts are secured to each other, e.g. by welding, and comprise a back part 2 and a front part 3. As is usual for this type of burner, the general shape of the body is approximately that of a rectangular parallelepiped with an open front.

The back part 2 is generally U-shaped, having a main face 4 which is approximately rectangular in this case, including an outwardly extending depression 5 between the branches of the U-shape (i.e. the depression extends outwardly). The depression 5 is longitudinally elongate in the main face 4 and it is shaped to include a short converging frustoconical portion 6 followed by a considerably longer diverging frustoconical portion 7, thereby making up half of a tubular Venturi. The general shape of the main face 4 as seen from behind can be seen clearly in FIG. 3.

At the two opposite longitudinal ends of the main face 4, the branches 8 and 9 respectively of the U-shape extend substantially perpendicularly to said main face 4 and extend away therefrom through a distance that is perceptibly greater than the maximum extent of the depression 5. The branches 8 and 9 made in this way are designed to form bracket members whereby the completed burner body can be rested on a support and can be fixed thereto under conditions explained below.

To ensure that the burner body is supported stably by the support, the ends of the branches 8 and 9 are folded through right angles, e.g. away from each other, so as to constitute substantially plane lugs 10 and 11. Each lug is provided with a plurality (e.g. two) of tabs 12 that are generally T-shaped (FIG. 4), being cut out and folded through a right angle so as to project substantially perpendicularly from the corresponding lug: the tabs 12 are designed to secure the burner body to its support by being engaged through corresponding slots in the support and then being twisted so as to place the cross-bars of their T-shapes behind the edges of the associated slots.

Figure 3:
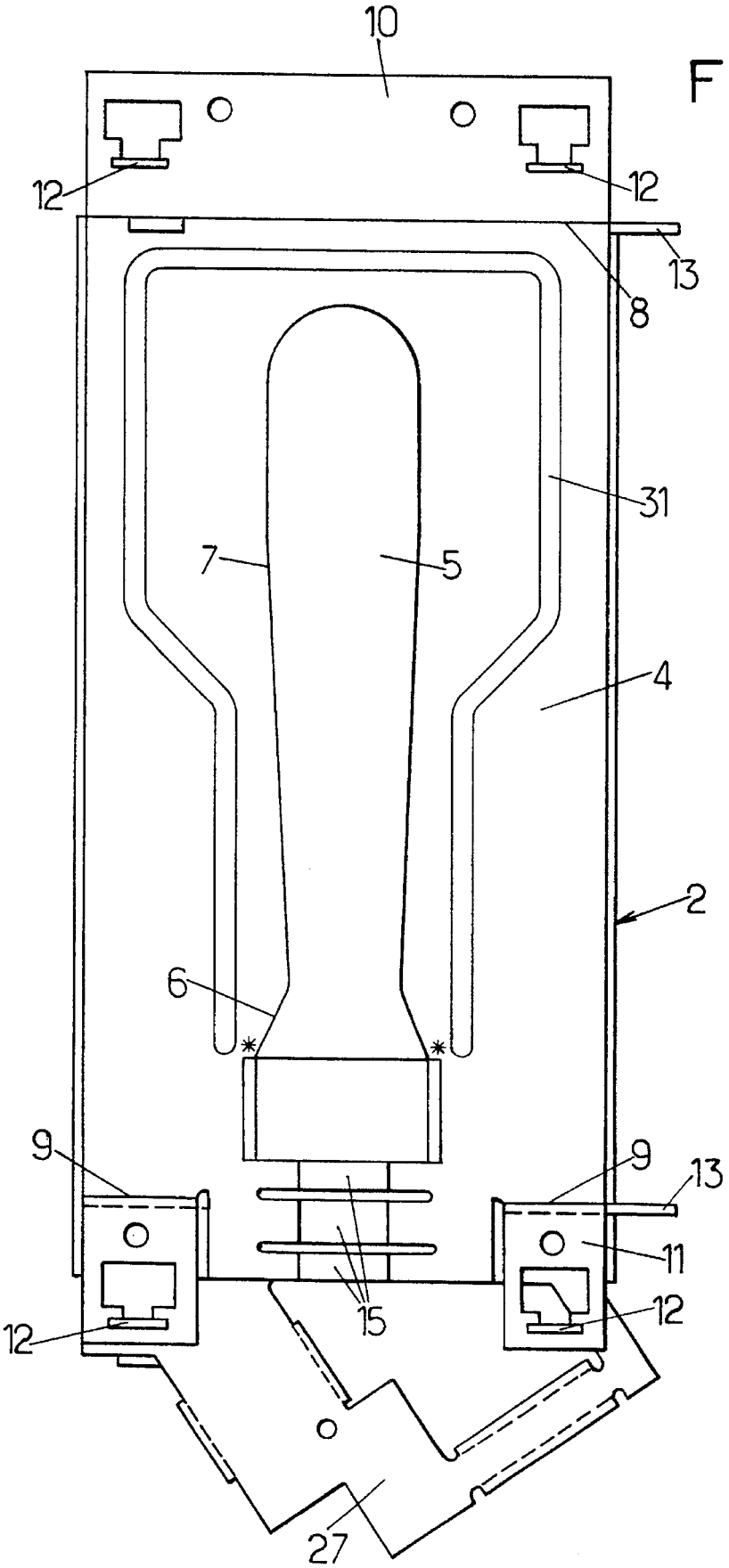
Figure 4:
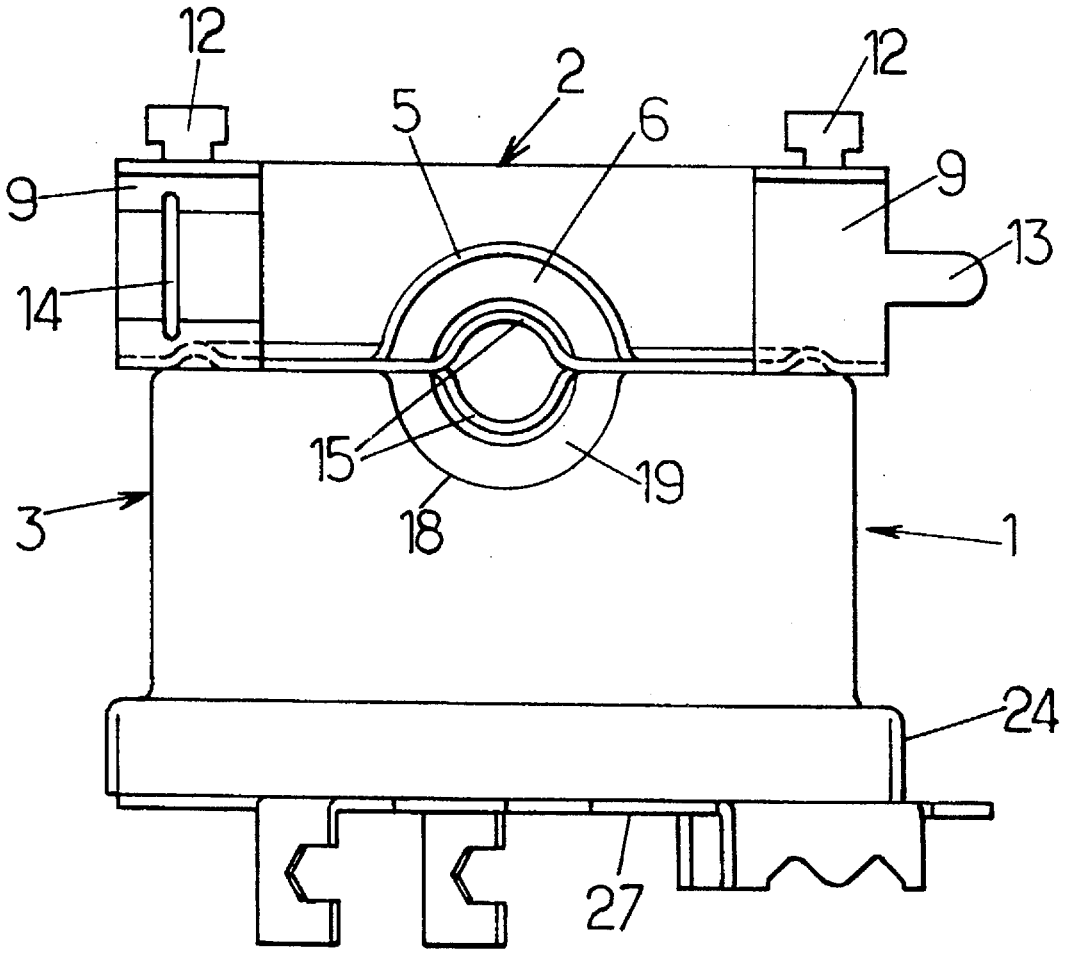
FIG. 4 is a view of the burner of FIGS. 1 to 3 showing its end adjacent to the Venturi inlet.

In the arrangement shown in FIGS. 1, 3, and 4, the branch 8 and the lug 10 extend continuously over the entire width of the back part 2, whereas the branch 9 and the lug 11 are discontinuous and are in the form of two sets of members disposed towards the side edges of the back part 2.

To enable two burner bodies 2 to be assembled side by side so as to build up burner assemblies that provide greater heating power, the following dispositions are also provided. Along one of the side edges of the back part 2 (e.g. the righthand side in FIG. 3), there are provided fingers 13 that project approximately perpendicularly to the side and that extend from the sides of the branches 8 and 9, for example. On the opposite sides of the branches 8 and 9, slots 14 are formed that are defined, for example, by two juxtaposed metal tongues which are first cut apart and then pushed apart vertically in opposite directions from each other (FIG. 1). The slots 14 are suitable for receiving the fingers 13 of an adjacent body, which fingers are subsequently folded so as to hold the two bodies together mechanically and side-by-side.

Finally, as shown in FIGS. 1, 3, and 4, the portion of the main face 4 that is situated upstream from the Venturi inlet, i.e. ahead of the frustoconical inlet portion 6 of the depression 5, is cut to form at least three parallel tongues 15 which are subsequently splayed apart backwards and forwards with one opposing the other two so that together they define a tubular guide assembly suitable for receiving and holding a gas injector 16 whose orifice is situated looking into the Venturi inlet (FIG. 1).

The front part 3 (see FIGS. 1, 2, and 3) is generally in the form of a small dish having a bottom 17 that is approximately rectangular and of substantially the same configuration as the main face 4 of the back part 2. The bottom 17 of the dish-shaped part is situated at the back thereof and has a vertically elongate depression 18 that projects into the dish, and that is shaped so as to constitute one-half of a tubular Venturi, comprising a short convergent frustoconical portion 19 followed by a considerably longer divergent frustoconical portion 20. The portions 19 and 20 coincide with the portions 6 and 7 respectively of the back part 2 so that together they define a tubular Venturi. Nevertheless, the portion 20 is shorter than the portion 7 facing it and the portion 17 facing the end of the portion 7 is cut along three sides to define an approximately rectangular plate 21 which is folded towards the inside of the dish: the plate 21 is perforated by a multitude of holes 22 and it extends in an inclined position over the outlet orifice 23 of the Venturi so as to act as a deflector that deflects the combustible mixed air and gas jet towards the opposite end of the dish that is remote from the orifice 23 so as to ensure that the dish is filled uniformly with the air-gas mixture.

Furthermore, the peripheral edge of the dish is shaped to define a rim 24 that extends around the entire perimeter of the dish and that is designed to support a plate for generating infrared radiation, e.g. a ceramic plate 25 (FIGS. 1 and 2). The portion of the rim 24 that is approximately parallel to the bottom 17 of the dish and against which the large face of the plate 25 bears is advantageously deformed so as to present a furrow 26 that extends continuously around the entire length of the rim 24 to receive an adhesive (not shown) for securing the plate 25 in leakproof manner.

Finally, the edge of the rim level with the Venturi inlet extends, e.g. substantially parallel to the bottom 17 of the dish, in the form of an external tab 27 which is shaped by cutting and folding so as to support various auxiliary members of the burner, e.g. an electrical igniter 28, a thermocouple sensor 29 for monitoring the burner, and an atmosphere-monitoring pilot 30 (FIGS. 1 and 2). To facilitate assembly, it is possible to provide retaining and positioning notches for said auxiliary members, either in appropriate zones of the edge of the tab 27, or else in a cover or the like 32 which is placed over the tab 27 for holding said members in place. The shape of the tab 27 as shown in the figures is given merely by way of example, and other arrangements could be considered without going beyond the ambit of the invention.

The back part 2 and the front part 3 as described above can be implemented in the form of two integral parts each incorporating all of the corresponding elements mentioned, said parts being manufactured by applying operations of cutting, stamping, and folding to two respective sheet metal blanks. The two parts 2 and 3 are then assembled together, with the bottom 17 being made to overlie the main face 4 and being secured thereto by welding for example (e.g. spot welding) or by any other rapid fastening means such as mechanical assembly of the type whereby press-fit studs preformed in the two parts 2 and 3 are caused to engage one another. To ensure that said assembly is sealed against an air gas mixture under fairly low pressure, provision is made for the main face 4 and for the bottom 17 of the dish to present respective complementary grooves 31 that fit one within the other so as to co-operate to constitute a sealing gasket that extends continuously around the depressions 5 and 18 that together define the Venturi and the opening 23.

Naturally, and as can be seen from the above, the invention is not limited in any way to the particular application and embodiment described in detail above; on the contrary, the invention extends to any variants thereof.

I claim:

1. A metal body (1) for a gas burner suitable for use with an infrared radiant heater appliance, the body (1) having a generally elongate shape with an open front which is designed to receive a plate of an infrared heating appliance that generates infrared radiation, the body being constituted by two sheet metal parts (2, 3) that are cut out, stamped, and folded, said sheet metal parts (2, 3) comprising:

a generally U-shaped back part (2) formed by two branches (8, 9) and an elongate main face (4) with a depression (5) that projects outwards between the branches (8, 9) of the U-shaped back part (2) and that is longitudinally elongate, which depression (5) has an maximum depth and constitutes one-half of a tubular venturi shape, the branches (8, 9) of the U-shaped back part (2) extending a distance that is significantly greater than the maximum depth of the depression (5) such that the branches (8, 9) can engage a support; and a front part (3) that is generally dish-shaped having an inside and an elongate bottom (17) of substantially the same shape as the main face (4) of the U-shaped back part (2) and presenting a longitudinally elongate depression (18) projecting into the dish-shaped front part (3), said depression (18) being shaped to constitute half a tubular venturi shape with an inlet and an outlet, a portion of said bottom (17) situated beyond the outlet of the venturi shape being cut out and folded towards the inside of the dish-shaped front part (3), so as to define an outlet opening (23) through which a mixture of gases flows from the outlet of the venturi shape and the inside of the dish-shaped front part (3), thereby forming a deflector (21) suitable for distributing the mixture of gases inside the dish-shaped front part (3); and wherein said back and front parts (2, 3) are secured to each other after each of them has been formed individually by securing the main face (4) of the back part (2) to the bottom (17) of the dish-shaped front part (3).

2. A metal body (1) according to claim 1, wherein upstream from the inlet to the venturi shape, the main face (4) of the back part (2) is cut out to form at least three parallel tongues (15), one being curved oppositely to the other two so that together they constitute a tubular guide for retaining a gas injector (16) situated facing the inlet of the venturi shape.

3. A metal body (1) according to claim 1, wherein a peripheral edge of the dish-shaped front part (3) is formed to define a peripheral rim (24) that is capable of supporting a ceramic infrared radiation generating plate (25).

4. A metal body (1) according to claim 3, wherein the peripheral rim (24) of the dish-shaped front part (3) is extended, adjacent to the inlet of the venturi shape, by an external tab (27) extending approximately parallel to the bottom of the dish-shaped front part (3) and is shaped to support burner accessories (28, 29, 30).

5. A metal body (1) according to claim 3, wherein the peripheral rim (24) has at least one continuous furrow (26) formed by stamping a portion of rim (24) against which a ceramic infrared radiation generating plate (25) bears when such a plate is supported on said rim (24), the furrow serving to receive an adhesive for securing ceramic plate (25) in sealing manner.

6. A metal body (1) according to claim 1, wherein the branches (8, 9) of the U-shape formed by the back part (2) have end portions which are curved at least in part so as to extend approximately parallel to the main face (4) of said back part (2) to form plane brackets (10, 11) for resting against a support, and wherein said plane brackets (10, 11) include projecting transverse tabs (12) that are cut out and folded for the purpose of achieving rapid fixing with said support.

7. A metal body (1) according to claim 1, wherein the branches (8, 9) of the U-shape formed by the back part (2) are situated at longitudinal ends of the main face (4) of said back part (2), and the back part (2) includes side edges which present two cutout fingers (13) that project sideways, and sideways-directed slots (14) defined by tongues that are cut out and deformed in opposite directions to each other, so as to receive said fingers (13) in order to enable a plurality of unitary gas burners to be secured to one another in a side-by-side relationship.

8. A metal body (1) according to claim 1, wherein the back part (2) and the front part (3) are secured to each other by spot welding.

9. A metal body (1) according to claim 1, wherein the main face (4) of the back part (2) and the bottom (17) of the dish-shaped front part (3) which cooperate with their faces pressed closely one against the other are provided with two respective complementary grooves (31) received one in the other and extending in a continuous manner around the venturi shape and the outlet opening (23) of the venturi shape, said complementary grooves (31) forming a sealing gasket for the gas mixture.

10. A metal body (1) according to claim 1, wherein the deflector (21) is cut out from the bottom (17) of the dish-shaped front part (3) is folded forwards and is pierced by a multiplicity of through holes (22).

* * * * *

UNITED STATES PATENT AND TRADEMARK OFFICE

CERTIFICATE OF CORRECTION

PATENT NO. : 5,593,300

DATED : January 14, 1997

INVENTOR(S) : LE MONNIER DE GOUVILLE

It is certified that error appears in the above-indentified patent and that said Letters Patent is hereby corrected as shown below:

On the Title page item [75], should read:

Inventor: Jean-Bernard LE MONNIER DE GOUVILLE
Joue-les-Tours, France

Signed and Sealed this

First Day of April, 1997

Bruce Lehman

*Attest:*

BRUCE LEHMAN

*Attesting Officer*

*Commissioner of Patents and Trademarks*